United States Patent [19]

Jinkins et al.

[11] 4,397,060

[45] Aug. 9, 1983

[54] VACUUM CLEANER TOOL FOR USE ON HORIZONTAL AND VERTICAL SURFACES

[75] Inventors: Danny R. Jinkins, Bel Air; William R. Lessig, III, Cockeysville; Timothy J. Canatella, Baltimore, all of Md.

[73] Assignee: Black & Decker Inc., Newark, Del.

[21] Appl. No.: 247,826

[22] Filed: Mar. 26, 1981

[51] Int. Cl.[3] ..... A47L 9/04

[52] U.S. Cl. ..... 15/377; 15/387; 15/410; 15/417

[58] Field of Search ..... 15/387, 377, 393–402, 15/410, 415 R, 416–422, 350

[56] References Cited

U.S. PATENT DOCUMENTS

| | | | |
|---|---|---|---|
| 2,203,088 | 6/1940 | Hansson | 15/399 X |
| 2,632,914 | 3/1953 | White | 15/416 X |
| 2,703,904 | 3/1955 | DeLong | 15/420 X |
| 2,962,748 | 12/1960 | Magarian | 15/387 |
| 2,963,270 | 12/1960 | Magarian | 253/40 |
| 3,079,623 | 3/1963 | Congdon | 15/417 X |
| 3,079,626 | 3/1963 | Yonkers et al. | 15/400 X |
| 3,688,339 | 9/1972 | Vincent et al. | 15/387 |
| 3,750,222 | 8/1973 | Johnson | 15/416 |
| 4,305,176 | 12/1981 | Lessig et al. | 15/387 X |

*Primary Examiner*—Chris K. Moore
*Attorney, Agent, or Firm*—R. B. Sherer; Harold Weinstein; C. E. Yocum

[57] ABSTRACT

A vacuum cleaner tool is removably mounted on the elongated wand of a conventional vacuum cleaner. The tool includes a head or main housing having a forwardly-disposed brush enclosure portion with a lower planar opening formed therein. A brush is rotatably journaled in the brush enclosure portion of the housing and protrudes below the opening therein. An air turbine is rotatably journaled in the housing and is drivingly connected to the brush. The axis of the housing is coincident with the axis of the wand, and both are arranged at 45 degrees with respect to the planar opening for the brush. In one position, the planar opening is in a horizontal plane. The mounting means between the housing and the wand includes a swivel member. This swivel member enables the housing to be rotated 180 degrees with respect to the wand. When so rotated, the planar opening for the brush is in a vertical plane. As a result, the tool facilitates the cleaning of horizontal and vertical surfaces (such as stair steps) without requiring the operator to change the orientation of the wand with respect to the working surfaces.

3 Claims, 8 Drawing Figures

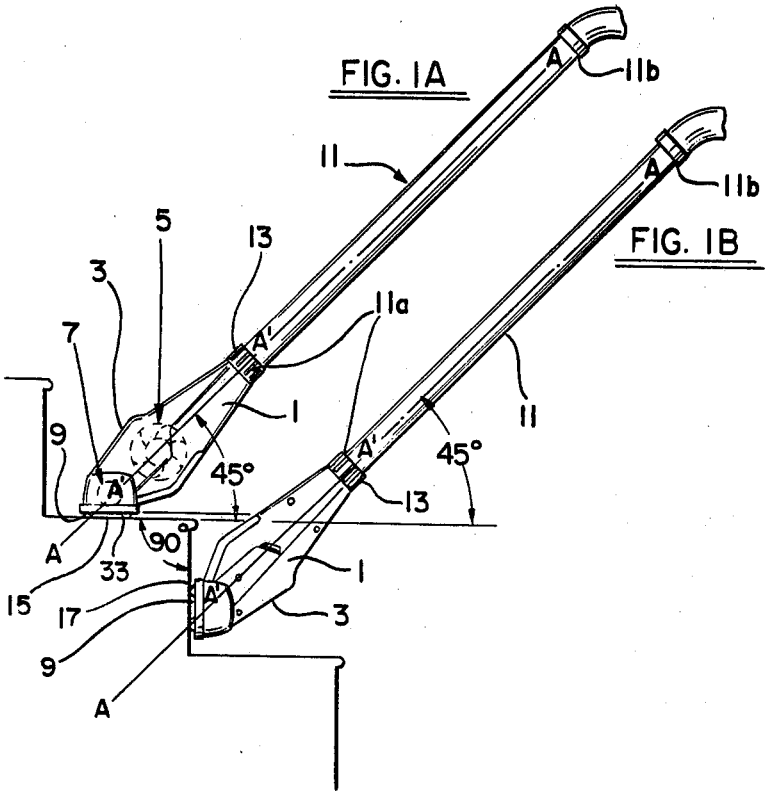
FIG. 1A
FIG. 1B
11
11b
11a
5
13
3
7
9
A
A'
1
45°
90°
33
15
17
11
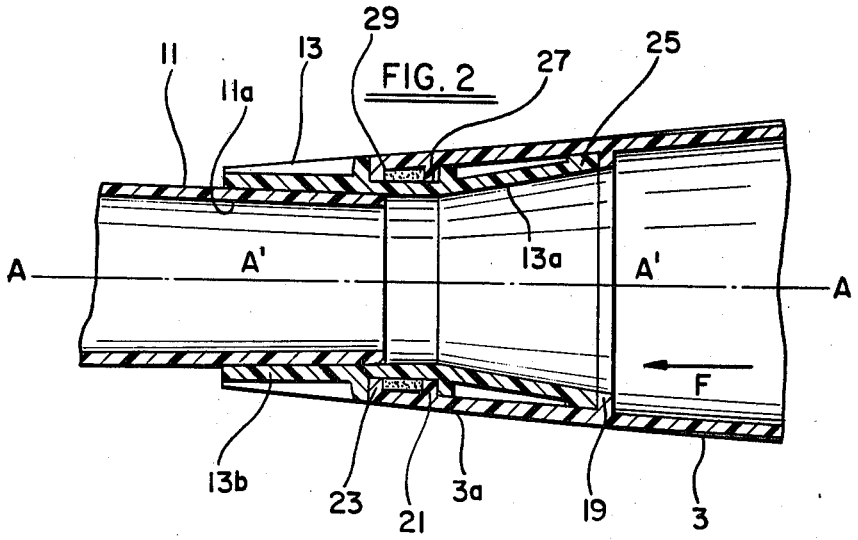
FIG. 2
11
11a
13
29
27
25
A
A'
13a
F
13b
23
21
3a
19
3

VACUUM CLEANER TOOL FOR USE ON HORIZONTAL AND VERTICAL SURFACES

BACKGROUND OF THE INVENTION

1. Field of the Invention

The present invention is directed to a vacuum cleaner tool for use in a household, office or light industrial environment for cleaning carpets, floors, walls, and other vertical and horizontal surfaces, draperies, upholstery, etc. and, in particular, to a vacuum cleaner tool which has an opening therein and a swivel mechanism which enables the user to vacuum perpendicular surfaces without changing the orientation of the wand, hose or the like, which couples the tool to the vacuum cleaner. Further, the present invention is directed to a vacuum cleaner tool having an air-powered turbine motor for driving an agitator device, such as a brush, which extends from the housing and, in particular, to a vacuum cleaner tool having an agitator brush extending from the housing in which the housing has a removable wall portion which incorporates an air nozzle for the air turbine and which, when removed, allows access to the turbine and brush for the removal of large particles which may be obstructing the tool.

2. Description of the Prior Art

The use of a vacuum cleaner tool to vacuum steps has been a problem in the past because the step contains two perpendicular surfaces, the horizontal tread portion and the vertical riser portion. When vacuuming steps, an operator holds a vacuum cleaner wand or hose, or other coupling device, which couples the vacuum cleaner to the tool and brings the tool into contact with the surface to be vacuumed. In prior art vacuum cleaners, the coupling device would have to be held in one position for vacuuming the horizontal trend portion and then held in a different position for vacuuming the vertical riser portion.

It has been known in the prior art to provide a swivel mechanism for coupling the tool to a vacuum cleaner wand so that the tool may be rotated with respect to the axis of the wand. Typical examples of such swivel mechanisms can be found in U.S. Pat. Nos. 981,893 and 3,667,084. In the prior art swivel mechanisms of these types, however, the axis of the swivel mechanism is not in alignment with the axis of the wand. In other prior art vacuum cleaner floor tools, such as in U.S. Pat. No. 3,688,339, the opening in the floor tool is oriented at an angle with respect to the axis of the coupling portion of the floor tool. The angle of orientation is, however, very small and the floor tool is fixed and does not rotate with respect to the wand or hose.

Other types of vacuum cleaner floor tools, such as that disclosed in U.S. Pat. No. 2,844,841 have rotatable floor contact portions for the purpose of altering the floor contact surface for vacuuming either carpet or hard floors. However, floor tools of this type do not have any provision for the rotation of the floor tool itself to permit the vacuuming of vertical and horizontal surfaces without reorienting the position of the wand.

Other examples of prior art vacuum cleaner tools are shown in U.S. design Pat. Nos. 187,129 and 220,970.

Another problem frequently encountered in prior art vacuum cleaner tools having air-powered turbine motors is that the tool often picks up large articles, such as hairpins, pieces of paper, etc. which become caught in the tool and obstruct the flow of air therethrough. Prior art floor tools, such as those shown in U.S. Pat. No. 3,005,224 and 3,044,100, for example, provide small access holes into the floor tool for the removal of such large articles. However, in floor tools of this type, the size of the access hole is very often insufficient to provide for the quick and easy removal of the obstructing article.

In prior art vacuum cleaner tools, incorporating an agitator brush and a drive means for driving the agitator brush, it is known to mount the motor driving the brush within the tool housing and then to place the drive pulley and belt which couple the motor to the brush within a separate compartment within the housing. Placing the pulley and belt in a separate compartment prevents dirt which is picked up by the floor tool from coming into contact with the pulley and belt, thereby causing damage or decreasing the efficiency of the drive mechanism. However, in those tools disclosed in U.S. Pat. Nos. 1,449,003; 2,584,495; 2,648,868; 2,962,748; 2,963,270 and 3,916,476, no air seal is provided between the compartment containing the pulley and drive belt and the portion of the housing which contains the drive motor. Thus, when the floor tool is in operation, air will be drawn from the pulley and belt compartment into the main stream of flow through the motor compartment, thereby creating turbulence in the main stream of flow. This results in a reduction in the efficiency of the floor tool and the generation of noise.

SUMMARY OF THE INVENTION

It is the primary object of the present invention to provide a vacuum cleaner tool wherein the tool may be rotated at a swivel so that a user can vacuum either a horizontal or vertical surface without changing the orientation of the vacuum cleaner wand, hose or other coupling device.

It is another object of the present invention to provide a vacuum cleaner tool which includes a swivel mechanism for coupling the tool to a coupling device which couples it to a vacuum cleaner, wherein the swivel mechanism includes structure for providing an air seal between the swivel mechanism and the housing of the tool to prevent air leaks therebetween, and thereby reduce turbulence and increase operating efficiency of the tool.

It is still a further object of the present invention to provide a vacuum cleaner tool having an air-powered turbine motor with a housing having a removable wall portion. The removal of the wall portion allows access to a rotary agitator enclosure, air nozzle and air turbine chamber of the tool. This removable portion includes the air nozzle which carries air from the brush enclosing portion of the housing to the turbine chamber of the air-powered turbine motor.

It is still a further object of the present invention to provide a vacuum cleaner tool having an air-powered turbine motor with a housing having a separate compartment for a pulley and drive belt which drives a rotary agitator of the tool, and to provide an air seal between the pulley and belt compartment and the portion of the housing having the turbine motor therein, in order to prevent air leaks from the pulley and belt compartment into the remaining portion of the housing. The elimination of the air leaks will reduce turbulence and noise and enhance the overall efficiency of the flow of the main stream of the air through the tool.

The present invention is directed to a vacuum cleaner tool which comprises a housing having an opening in one surface thereof through which air and dirt are drawn and, when the tool is being used to vacuum a surface, the opening faces the surface which is to be vacuumed. A swivel mechanism couples the floor tool to a wand, hose or other coupling device of the vacuum cleaner, and permits the tool to be rotated about the axis of the swivel mechanism. The plane of the opening is oriented at 45° with respect to the axis of the swivel mechanism. Thus, when the tool is rotated 180° about the axis of the swivel mechanism, the orientation of the plane of the opening is rotated 90° with respect to its initial orientation or position. The tool may include an air-powered turbine motor powered by the vacuum of the vacuum cleaner, and a rotary agitator device, such as a brush, which is driven by the motor. An electric motor may be used instead of the air-powered turbine motor. The brush extends from the housing through the opening therein. The swivel mechanism includes structure for forming an air seal with the housing to prevent air leaks through the swivel mechanism. Further, the output shaft of the motor extends into a separate compartment within the housing. A pulley is mounted on the end of the output shaft, another pulley is mounted on the brush and a drive belt extends between the two pulleys. The pulley on the output shaft of the motor and the drive belt are positioned within the separate compartment within the housing and the pulley and the drive belt compartment is sealed from the portion of the housing containing the motor in order to prevent leaks and enhance the efficiency of the vacuum cleaner and turbine motor. The brush is enclosed within a brush enclosure portion of the housing and the housing further includes a removable wall portion which has an air nozzle positioned thereon. The air nozzle extends from the brush enclosure portion to the turbine chamber of the air-powered turbine motor, and forms at least a portion of the peripheral wall of the turbine chamber. The nozzle directs air from the brush enclosure into the turbine motor.

BRIEF DESCRIPTION OF THE DRAWINGS

FIGS. 1A and 1B illustrate a vacuum cleaner tool of the present invention in two different positions of orientation;

FIG. 2 is a sectional view of the swivel mechanism of the tool of the present invention;

DETAILED DESCRIPTION OF THE PREFERRED EMBODIMENT

Figure 3:
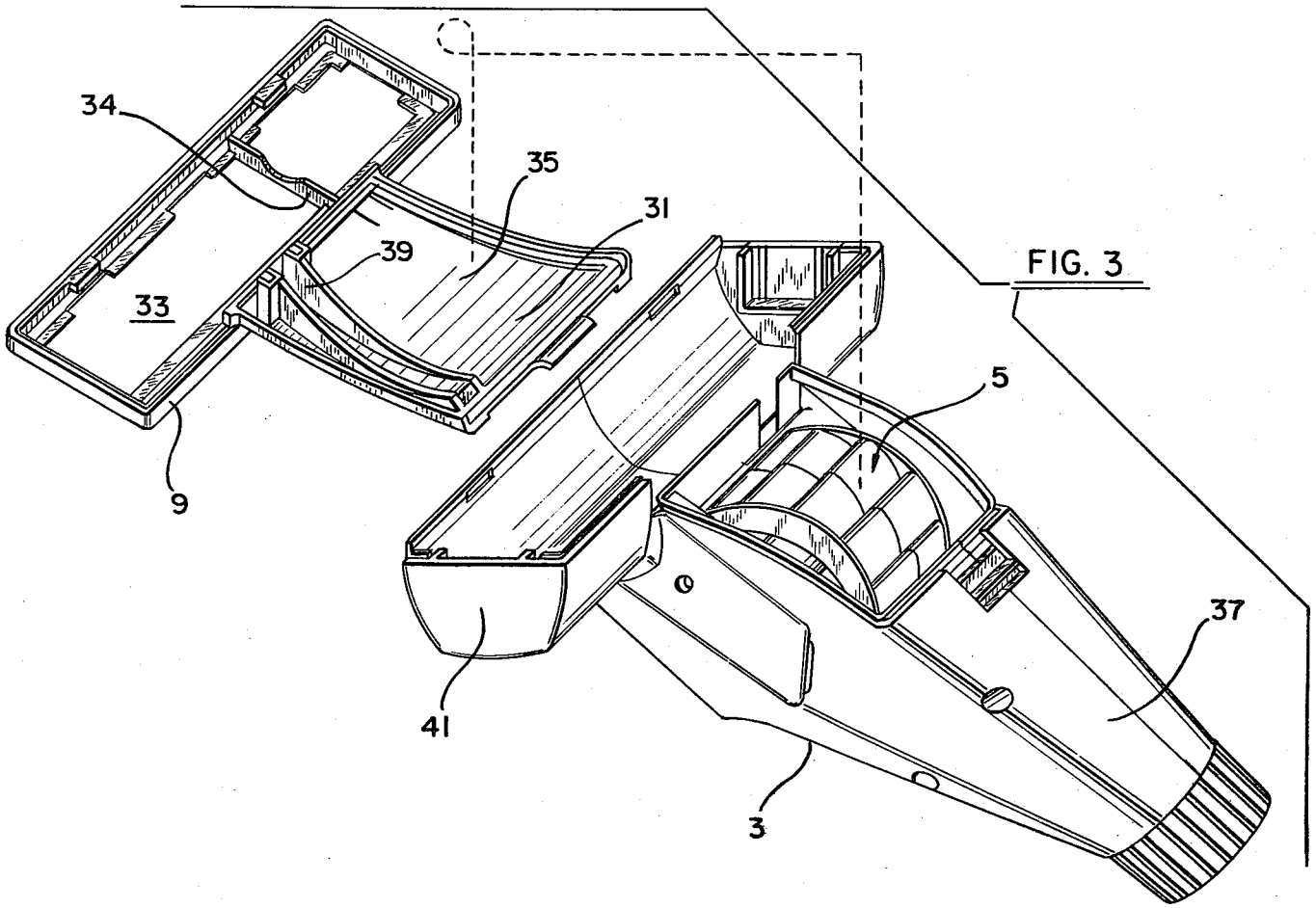
FIG. 3 is an exploded view of the housing of the tools of the present invention with a rotated removable portion.
Figure 5:
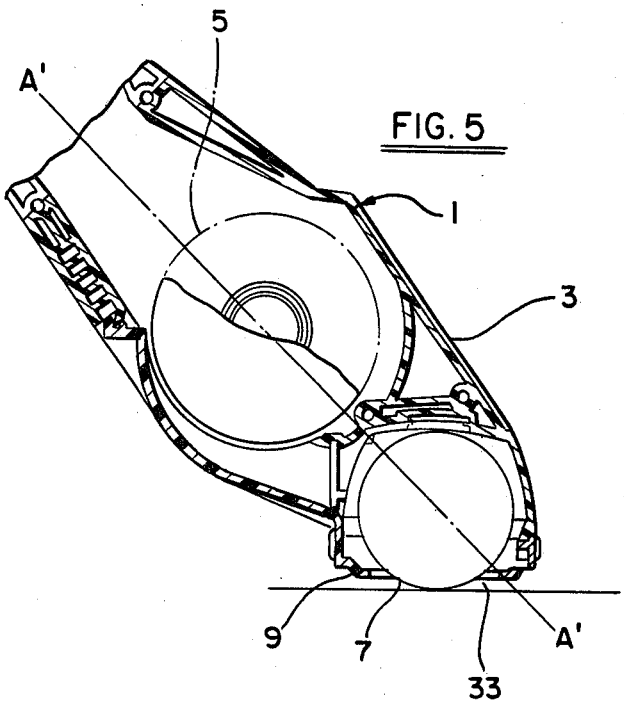
FIG. 5 is a sectional elevation view of the housing and motor of the tool of the present invention.

FIG. 1A illustrates a tool of the present invention oriented for vacuuming a horizontal tread portion of a step, and FIG. 1B illustrates the same tool oriented for vacuuming on the vertical riser portion of a step.

Referring to the drawings, tool 1 has a housing 3 which houses an air-powered turbine motor 5 which drives a rotary agitator brush 7. Other types of agitator means, such as beater bars, can also be used. The rotary brush 7 extends from an opening 33 in the surface 9 of the housing 3. Preferably, but not necessarily, the opening 33 is substantially planar (as shown in the drawings). The dirt and air drawn by the vacuum cleaner flows through the opening 33. The tool 1 is coupled to a portion of a vacuum cleaner controlled by the operator, such as an elongated wand 11, by means of a rotatable mounting means which includes a swivel member 13. The axis A-A of the wand 11 coincides with the axis of the swivel member 13, and the swivel member 13 permits the housing 3 to be rotated about the axis A-A. The axis of the swivel member also coincides with the axis A′—A′ of the housing 3. This not only permits the tool to be rotated in the manner discussed below, but also causes the tool to be balanced and thereby makes it easier to use.

The axis A′—A′ is oriented at 45° with respect to the horizontal tread portion 15 of the step and the surface 9 of the tool, which has the opening 33 therein through which the brush 7 extends, is positioned parallel to the horizontal tread portion 15. The end **11*b* of the vacuum cleaner wand 11** is connected to a vacuum cleaner (not shown).

FIG. 1B illustrates the orientation of the tool 3 when the tool is rotated 180° about the axis A′—A′ by means of the swivel member 13. In this orientation, the surface 9 of the tool 3 is positioned vertically and faces the vertical riser surface 17 of the step. It can be seen that the orientation of the vacuum cleaner wand 11 is the same as that in FIG. 1A. Thus, a user of the vacuum cleaner tool, when desiring to switch from a horizontal surface to a vertical surface, merely rotates the housing 3 of the tool 1 through a turn of 180° about the axis A′—A′. This results in the surface 9 of the housing 3, which has the opening for the brush 7 therein, being rotated 90° with respect to its initial orientation, i.e., from horizontal to vertical or vertical to horizontal. Although the swivel member is illustrated as positioned at the end **11*a* of the wand 11, it can also be positioned at end 11*b* with the end 11*a* being coupled directly to the housing 3**.

FIG. 2 illustrates the swivel member of the present invention. Referring to FIG. 2, the end portion **3*a* of the housing 3 has a first flange 19, a second flange 21 and a third flange 23, which extend inwardly into the housing. The swivel member 13 has an end portion 25 and a notch 27 wherein the flanges 21 and 23 are positioned in the notch 27. An annular resilient member 29 of a material such as felt is positioned between flanges 21 and 23 and contacts the housing 3 and the swivel member 13** to form an air seal therebetween. This prevents air from leaking into the housing through the swivel member.

Contact between the swivel member 13 and the housing 3 is made by the flanges 21 and 23, which contact portions of the bottom and sides of the notch 27 of the swivel member 13, and by the end portion 25 of the swivel member 13 which contacts flange 19 and a portion of the interior wall of the housing 3. The housing 3 is a clam-shell type of housing, and its two halves are placed around the swivel member 13 and then fixed together. The flange and notch structure of the contact between the housing and swivel member provides for a relatively small contact surface between these two members. Thus, there is low friction between these members, which permits easy rotation of the housing about the axis A′—A′ because of low friction and further the manufacturing tolerances can be large.

The housing portion 3*a* and the forward portion 13*a* of the swivel member are tapered as illustrated in FIG. 2. The tapering of the housing and the swivel body member in this manner reduces the air turbulence as air, flowing in the direction F, enters the swivel member and the wand which is fitted into the swivel member.

The portion 13*b* of the swivel member which engages the wand 11 at the end 11*a* thereof is tapered in a direction opposite to the direction of the taper of portion 13*a* of the swivel member. This tapered portion enables the wand 11 to be inserted and held within the swivel member without the necessity for a special holding member.

Referring to FIG. 3, the tool housing 3 has a removable cover plate or portion 31, which is shown in a rotated orientation to expose its interior structure and which covers the substantially open bottom portion of the housing 3 (below the turbine 5) as shown more clearly in FIG. 3 of the drawings. The removable portion includes the surface 9, which has an opening 33 therein through which the brush 7 extends. A belt guard 34 covers a portion of the opening 33. The dirt and air from the surface being vacuumed are drawn through opening 33. The removable portion 31 also has a portion 35 which forms a portion of underside 37 of the housing 3. The turbine 5 is positioned within the housing 3 as illustrated in FIG. 3, and the portion 35 of the removable portion 31 forms a peripheral wall of the turbine chamber of the air-powered turbine motor 5.

An inlet ramp or nozzle 39 is integrally formed on the portion 35 of the removable portion. Also 31. The inlet nozzle (or ramp) directs air from the brush enclosure portion 41 (or agitator housing portion) of the housing 3 into the turbine chamber. Preferably, and as shown more clearly in FIG. 3, the nozzle (or ramp) is channel-shaped and includes a pair of parallel upstanding walls. These walls are preferably sloped (as shown) in a direction forwardly of the housing 3; and when the removable cover portion 31 is secured to the open bottom of the housing 3 (as indicated by the broken lines in FIG. 3) the ramp will radially overlay an axial portion of the turbine 5 and will be spaced therefrom to provide for the proper flow of incoming air into the turbine.

As can be seen from FIG. 3, the removal of the removable member 31 from the remainder of the housing 3 provides complete and ready access to the brush enclosure portion 41, turbine housing and inlet nozzle 39 so that articles such as hairpins, pieces of paper, etc. which may become lodged in these areas and obstruct the flow to the vacuum cleaner can be easily removed.

Figure 4:
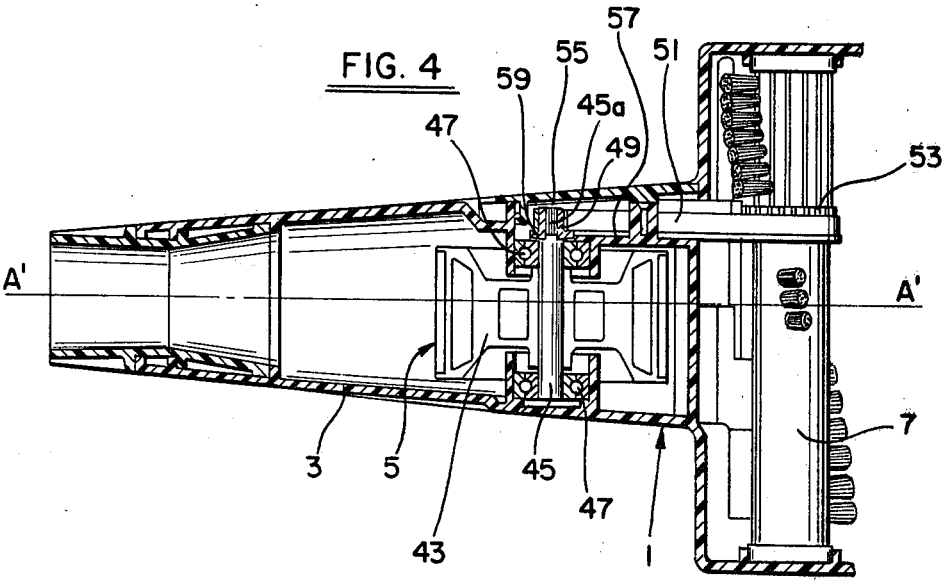
FIG. 4 is a sectional plan view of the housing, motor and drive mechanism of the tool of the present invention.

Referring to FIG. 4, the turbine rotor 43 is mounted on a shaft 45 supported on bearings 47. End 45*a* of shaft 45 has a drive pulley 49 mounted thereon and a drive belt 51 operatively couples the pulley 49 to a driven pulley 53 mounted on the brush 7. The belt guard 34 covers that portion of the opening 33 opposite the driven pulley 53 to prevent contract between the pulley and the surface being vacuumed. The turbine motor is powered by the vacuum from a vacuum cleaner to which the tool is coupled, and the rotation of the rotor 43 results in the rotation of the brush 7 through the drive coupling mechanism, including the pulley 49, belt 51 and pulley 53. The pulley 49 and belt 51 are located in a separate compartment 55, which is separated from the turbine chamber by means of a wall 57. A seal 59 is formed between the pulley and drive belt compartment 55 and the turbine chamber to prevent air leaks therebetween and thereby maximize the flow of air through the nozzle 39.

Although the preferred embodiment of the present invention has been described in connection with the use of an air-powered turbine motor and a rotary actuator such as the brush, or beater bar, an electric motor can also be used in place of the air-powered turbine motor for driving the agitator. Still further, features of the present invention can be incorporated into a vacuum cleaner tool which does not include any type of driven agitator, thereby completely eliminating the motor and further into a tool which does not incorporate any type of agitator.

Figure 6:
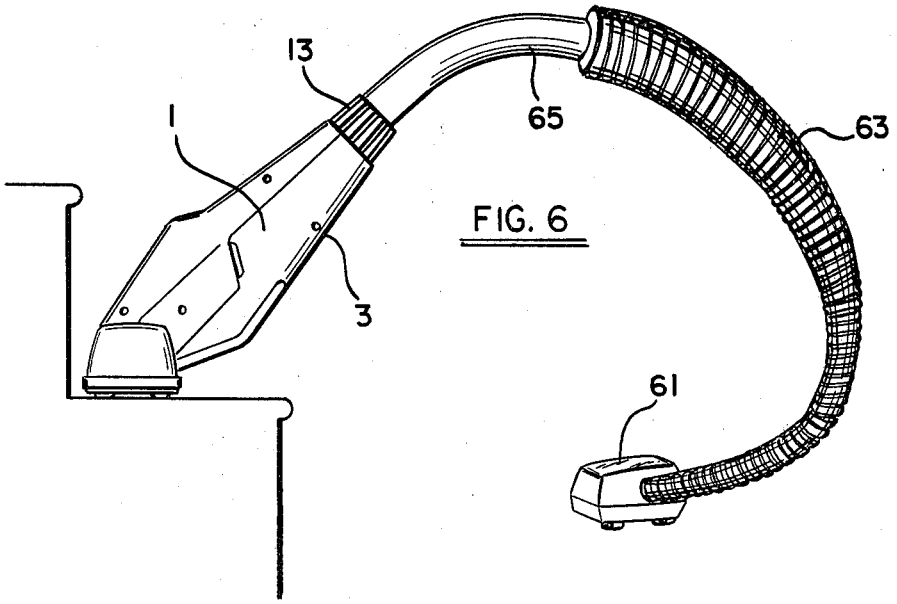
FIG. 6 illustrates an alternate embodiment of the present invention.

FIG. 6 illustrates an alternate embodiment of the present invention in which the housing 3 of the tool 1 is coupled to the vacuum 61 through a hose 63 having a coupling member 65 at one end thereof. In this embodiment of the present invention, the wand 11 has been deleted and the floor tool is connected directly to the vacuum cleaner hose.

Figure 7:
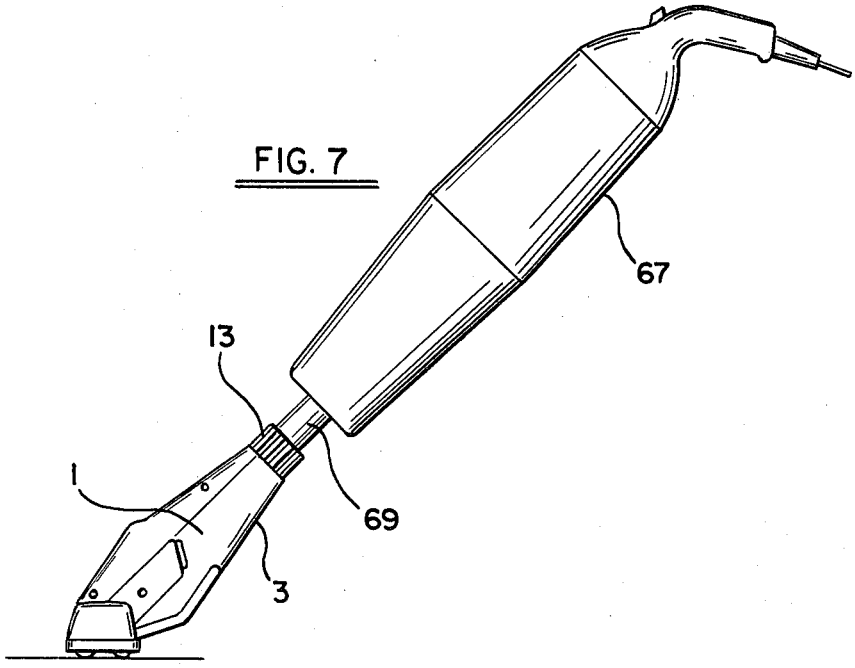
FIG. 7 illustrates another alternate embodiment of the present invention.

In the embodiment shown in FIG. 7, the housing 3 of the tool 1 is connected to a compact elongated portable vacuum cleaner 67. A coupling member or tube 69 extends from the vacuum cleaner housing and is coupled to the floor tool by means of swivel member 13. Smaller hand-held vacuum cleaners can also be used with the present invention by connecting the tool to the hand-held vacuum cleaner which has a coupling member similar to coupling 69 and extending therefrom.

The present invention may be embodied in other specific forms without departing from the spirit or essential characteristics thereof. The presently disclosed embodiments are, therefore, to be considered in all respects as illustrative and not restrictive, the scope of the invention being indicated by the appended claims rather than the foregoing description, and all changes which come within the meaning and range of equivalency of the claims are, therefore, to be embraced therein.

What is claimed:

1. A vacuum cleaner tool for use on horizontal and vertical work surfaces, said tool being intended for use with a vacuum cleaner having a portion including an elongated wand controlled by the operator, said tool comprising a housing including an agitator housing portion having a substantially planar opening formed therein, an agitator means rotatably journaled in the agitator housing and protruding below the opening therein, an air turbine having a shaft rotatably journaled in the housing about an axis substantially parallel to the axis of the agitator means, a transverse wall in the housing laterally of the air turbine, the shaft having a portion extending beyond the transverse wall, a driving pulley on the extending portion of the shaft, a driven pulley on the agitator means, a belt between the pulleys, thereby driving the agitator means from the air turbine, an air inlet means including an aperture formed between the housing and the agitator housing, the housing having a substantially open bottom portion, a cover plate removably secured to the open bottom portion of the housing, the cover plate having an upstanding channel-shaped ramp radially overlying a portion of the air turbine and spaced therefrom, the ramp having a forward portion in communication with the aperture between the housing and the agitator housing, whereby air drawn in through the planar opening in the agitator housing passes through the aperture and enters into the housing and is directed by the ramp for powering the air turbine, means for mounting the housing on the vacuum cleaner portion about an axis which is disposed substantially at 45 degrees with respect to the plane of the opening in the agitator housing, the housing having a first position with respect to the vacuum cleaner portion wherein the opening in the agitator housing is disposed in a substantially horizontal plane, thereby facilitating the cleaning of a horizontal work surface, and the mounting means including means for rotating the housing and its agitator housing portion substantially 180 degrees with respect to the vacuum cleaner portion and from the first position into a second position, wherein the opening in the agitator housing is disposed in a substantially vertical plane, thereby facilitating the cleaning of a vertical work surface without requiring the operator to change the orientation of the vacuum cleaner portion with respect to the work surface, said means for rotating including a swivel member between the wand and the housing, the swivel member being carried by the housing and having an external annular notch formed therein, wherein the housing has a pair of parallel internal annular flanges received within the notch, and the vacuum cleaner portion and the housing having respective axes which are substantially alined with one another and with the axis of the mounting means, whereby the tool is substantially balanced in both of its positions.

2. The combination of claim 1, further including an annular sealing member between the flanges.

3. The combination of claim 1, wherein the swivel member has an outwardly tapered end portion, and wherein the wand has a corresponding inwardly-tapered forward portion received in the end portion of the swivel member.

* * * * *